United States Patent [19]

Kartzmark, Jr.

[11] 4,033,225

[45] July 5, 1977

[54] HYDRODYNAMIC CONFIGURATION TO BE USED ON UNDERWATER LAUNCHED, UNPROPELLED BODIES

[75] Inventor: Roy M. Kartzmark, Jr., China Lake, Calif.

[73] Assignee: The United States of America as represented by the Secretary of the Navy, Washington, D.C.

[22] Filed: Feb. 6, 1974

[21] Appl. No.: 440,213

[52] U.S. Cl. ..... 89/1.81

[51] Int. Cl.[2] ..... F41F 3/04

[58] Field of Search ..... 89/5, 1.809, 1.81; 102/3; 114/22, 23, 25

[56] References Cited

UNITED STATES PATENTS

| | | | |
|---|---|---|---|
| 1,295,355 | 2/1919 | Myers | 114/23 |
| 2,984,181 | 5/1961 | Baldwin | 102/3 |
| 2,998,944 | 9/1961 | Rimmer | 89/1.81 |
| 3,016,827 | 1/1962 | Boyd | 102/3 |
| 3,170,431 | 2/1965 | Norviel | 114/23 |
| 3,204,596 | 9/1965 | Fallon | 114/25 |
| 3,499,364 | 3/1970 | D'Ooge | 89/1.81 |

*Primary Examiner*—Stephen C. Bentley

*Attorney, Agent, or Firm*—Richard S. Sciascia; Ervin F. Johnston

[57] ABSTRACT

An underwater launched, elongated, buoyant body which has fore and aft ends and a positive metacentric height. A pair of fins are mounted at the aft end of the body in a spaced apart relationship and each fin has a projection for acting in combination with the other projection to establish the body in a stabilized, straight line upward glide through the water. When the buoyant body is launched from its submerged position, it will assume a constant upward glide path which is stabilized in roll, pitch, and yaw.

1 Claim, 13 Drawing Figures

FIG. 1.
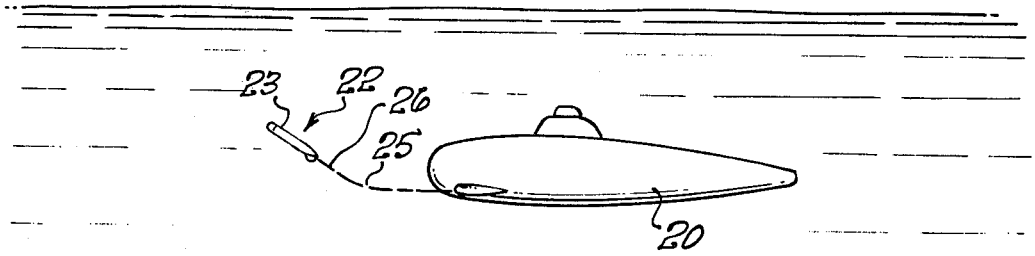
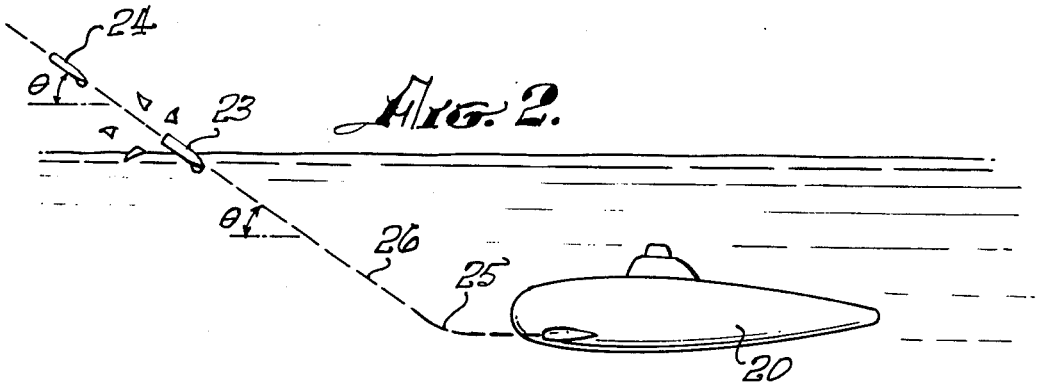
FIG. 2.
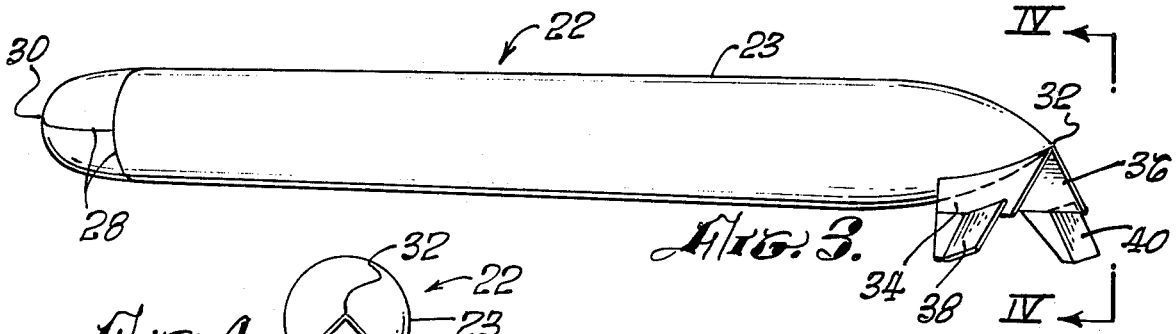
FIG. 3.
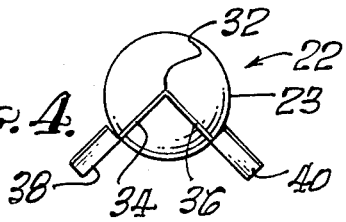
FIG. 4.
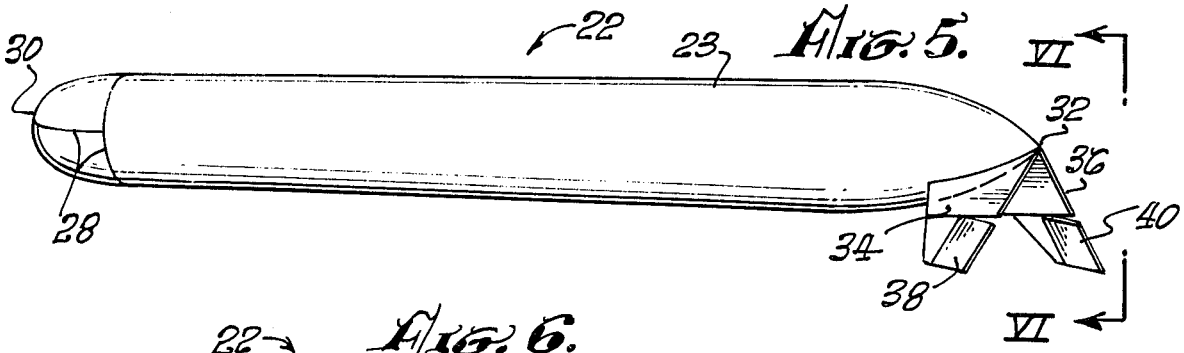
FIG. 5.
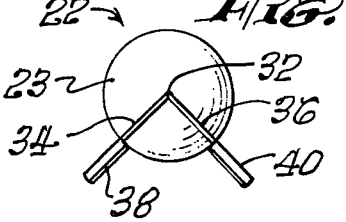
FIG. 6.

HYDRODYNAMIC CONFIGURATION TO BE USED ON UNDERWATER LAUNCHED, UNPROPELLED BODIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

In the past decade the submarine has been called upon to play an increasing role in the launching of weapon systems which break the air-sea interface. One of the present devices utilized for delivery of a weapon system to this interface is the SUBROC. This is a horizontally launched, rocket propelled missile which is exposed to the water and is controlled by a thrust vector control involving jetavators. Another device is WAM, which is a horizontally launched, rocket propelled missile which is exposed to the water and is controlled by a canard nose package. Both of these devices are denser than water and rely on the rocket propulsion to get to the surface. The rocket motor limits the depth at which the device can be launched and is a source of high amplitude noise. Both devices require active control systems which must operate in water and in air, thus requiring complex guidance hardware. Also, the missiles are exposed to water requiring them to be hardened to the hydrostatic pressure and sealed against water damage. Neither device can be simply released from the outer hull of a submarine due to the danger of igniting a rocket motor in the proximity of the submarine's pressure hull.

Another device considered for delivery of a weapons system to the air/water interface is the encapsulated POLARIS. This system is a hydrodynamically stable capsule vertically launched with a positive net buoyancy and encloses the POLARIS missile. The capsule must be launched at low speed. It has no roll stabilization, nor controls, and exists the water with a vertical attitude. This system requires a vertical tube in the submarine for its launch. When fired from the vertical tube, the water exit attitude is vertical. If fired from a horizontal tube, the water exit attitude would be a strong function of launch depth and would tend toward the vertical as the launch depth increases. The system's roll attitude at water exit would be random.

SUMMARY OF THE INVENTION

There is a strong need for a submarine launched weapon system which will quietly ascend to the air/sea interface, where a missile can be fired for a further trajectory toward a desired target. The quiet ascension is extremely important so as not to alert the enemy of the functioning weapon system. It is desirable that the weapon system include a capsule which contains a missile which, in turn, ultimately fires at the air/sea interface. It is desirable that the water exit angle and the water exit speed of the capsule be large enough to minimize the effect of wave action and give sufficient air travel for launching the encapsulated missile. It is further desirable that the water exit angle at the air/sea interface be substantially the same as the desired trajectory of the missile at the time of firing from the capsule. The present invention satisfies these parameters by providing a body, such as the capsule and contained missile, which after launch from the torpedo, will glide upwardly through the water at an angle which is equal to the desired water exit angle. This has been accomplished by providing an elongated buoyant body, such as the capsule and contained missile, which has fore and aft ends and which has a positive metacentric height. A pair of fins are mounted at the aft end of the body in a spaced apart relationship for stabilizing the body in roll and yaw, and each fin has a projection for acting in combination with the other projection to establish the body in a pitch stabilized straight line upward glide path through the water toward the air-sea interface. In a preferred embodiment the projections are tabs which are capable of deflecting from a downward position to an upward position, and means are provided for simultaneously changing the tabs from the upward positions to the downward positions at a preselected time. This preferred embodiment is capable of being launched from a torpedo tube of a submarine.

A special problem which the invention solves is the launching of the buoyant body from a submarine torpedo tube at a shallow depth. In order to ensure a satisfactory firing of the missile, the water exit angle of the capsule should be equal to or greater than 45 degrees and an out of the water tail height of the capsule should be approximately 12 to 15 feed. By a quick action of the tabs the capsule will assume the desired upward glide path and a strong buoyant force of the capsule and missile combination will assure the desired out of the water tail height.

In essence, the specially configured buoyant body of the present invention assumes, after launch, a glide which is the inverse of the ordinary downward glide of an airplane. By the special configuration the buoyant body is stabilized in roll, pitch, and yaw. The roll and yaw stabilization is implemented by the fins, and the pitch stabilization is implemented by the tabs on the fins.

OBJECTS OF THE INVENTION

An object of the present invention is to provide a submarine launched weapon system which will guietly ascend to the air/sea interface.

Another object is to provide an unpropelled weapon system which can be quietly launched and ascended from a submarine to the air/sea interface for further launch of a missile on a desired trajectory through the air.

A further object is to provide a weapon system which can be launched from a torpedo tube of a submarine at a shallow depth, and which will quietly ascend unpropelled through the water to the air/sea interface at a desired water exit angle and speed which will ensure satisfactory firing of a missile for further travel through the air.

These and other objects of the invention will become more readily apparent from the ensuing specification when taken with the drawings.

DESCRIPTION OF THE DRAWINGS

FIG. 1 is an ocean elevation view of the launching of the weapon system from a torpedo tube of a submarine.

FIG. 2 is an ocean elevation view of the missile firing at the air/sea interface and the dropping of the capsule.

FIG. 3 illustrates a side view of the weapons system of FIGS. 1 and 2 with the tabs positioned in an upward position to ensure a quick upward turn of the system toward the vertical.

FIG. 4 is a view taken along plane IV—IV of FIG. 3.

FIG. 5 illustrates the weapon system with the tabs shown in a downward position which will establish a desired upward glide path of the system in the water toward the air/sea interface.

FIG. 6 is a view taken along plane VI—VI of FIG. 5.

DESCRIPTION OF PREFERRED EMBODIMENTS

Figure 7:
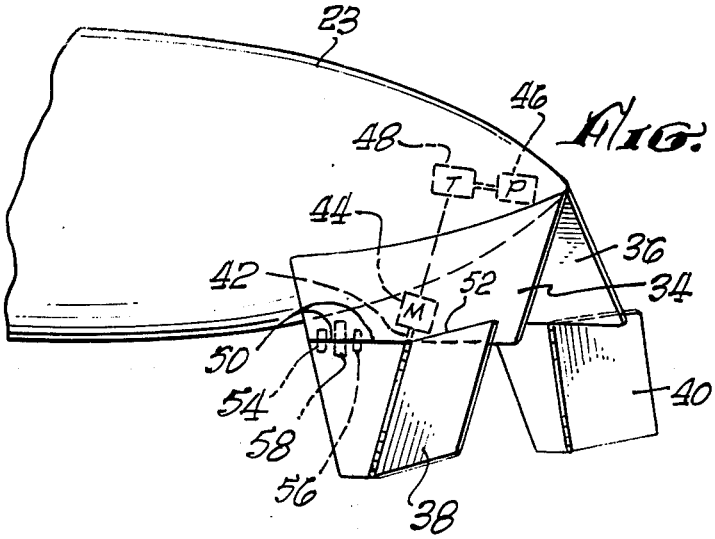
FIG. 7 is an enlarged schematic illustration of the details of the tail fins of FIGS. 3 through 5 as well as the means for rotating the tabs on the fins between two positions.

Referring now to the drawings, where like numerals designate like or similar parts throughout the several views there is illustrated in FIG. 1 a submarine 20 which has just launched a weapon system 22 from a torpedo tube of the submarine. The weapon system 22 is preferably a capsule 23 which contains a self-propelled missile 24 which is designed for firing at the air/sea interface. In FIG. 1 the capsule 23 has just exited the submarine 20 and has made a quick, upward turn to the point 25 along its path, after which time it ascends on an upward glide path 26 which is at an angle which is most desirable for launching the missile at the air/sea interface. The firing of the missile 24 at the air/sea interface is illustrated in FIG. 2. The means for accomplishing these manuevers will be described in detail hereinbelow.

FIGS. 3 through 7 illustrate the details of the capsule 23 for satisfying the parameters of a quiet launch and quiet ascending buoyant weapon system which will glide upwardly through the water at a desired speed for satisfactory firing of the missile 24 at the air/sea interface. As illustrated in FIG. 3, the weapon system includes the capsule 22 which may be opened along breaks 28 at its nose for enabling exit of the missile contained therein. These nose portions may be frangibly secured so that the thrust of the nose of the missile 24, upon firing, will break open the nose of the capsules. The capsule has fore and aft ends 30 and 32 and the weapon system 22 is positively buoyant with a positive metacentric height, namely the center buoyancy is between the fore end 30 and the center of gravity of the weapon system. A pair of fins 34 and 36 are mounted at the aft end of the capsule in a spaced apart relationship, preferably 90°. This 90° relationship establishes a dihedral effect to stabilize the weapon system in roll and yaw which will be explained more fully hereinafter.

Each fin 34 and 36 has a respective projection, preferably tabs 38 and 40, which are capable of deflecting from an upward position, as illustrated in FIGS. 3 and 4, to a downward position as illustrated in FIGS. 5 and 6. The upward position of the tabs act in combination to implement a pitching movement of the weapon system toward a vertically upward path in the water. This position of the tabs is utilized to quickly pitch the weapon system 22 upwardly from the horizontal firing position from the torpedo tubes to the desired flight path 26 which starts at point 25 in FIG. 1. The downward position of the tabs, as illustrated in FIGS. 5 and 6, act in combination to implement the straight line upward glide path 26 through the water, as illustrated in FIG. 2. This glide path preferably is at an angle which is equal to the desired firing angle of the missile 24 as it exits the capsule at the air/sea interface (see FIG. 2). This angle is normally equal to or greater than 45°. For satisfactory firing of the missile at the air/sea interface, it is desirable that the upward buoyant force of the weapon system 22 be large enough to ensure a tail height of the capsule 23 out of the water approximately 12 to 15 feet. It should be noted that the capsule 23 has a smooth, unimpeded cylindrical configuration except for the fins 34 and 36, and the tabs 38 and 40.

The glide path of the weapon system 22 is essentially the opposite of the glide path of a normal aircraft. The downward deflection of the tabs 38 and 40 imposes a nose down moment on the weapon system 22 which will counteract and equal the moments due to weight, buoyancy, and angle attack of the weapon system as it ascends in the water. Regardless of what the initial attitude and speed of the weapon system is, it will accelerate and rotate to a specific equilibrium condition where drag, lift, weight, and buoyancy cancel each other and where the pitching moments due to buoyancy, weight, and angle of attach are cancelled by the pitching moment due to the downward tab deflection. However, when a launch is made from a torpedo tube of a submarine, it is desirable to quickly turn the weapon system out of the path of the submarine so as not to interfere with the submarine mobility. This has been accomplished by the upward position of the tabs, as illustrated in FIGS. 3 and 4 to ensure the quick pitching movement after the weapon system leaves the torpedo tube to the desired glide path which commences at point 25 in FIGS. 1 and 2. It is this quick upward pitching movement which enables the weapon system 22 to be satisfactorily launched from the torpedo tube of a submarine at a shallow depth.

In order to make the transition from the quick upward pitching manuever, as illustrated in FIG. 1, to the stabilized upward glide path, as illustrated in FIG. 2, means are provided for simultaneously changing the tabs 38 and 40 from the upward positions, as illustrated in FIGS. 3 and 4 to the downward positions, as illustrated in FIGS. 5 and 6, at a pre-selected time. As illustrated in FIG. 1 the pre-selected time will be at point 25 which is the point in the path where the weapon system 22 assumes the desired attitude for a final glide 26 to the surface of the water. It is desirable that this glide angle be equal to he desired firing angle of the missile 24 at the air/sea interface. Exemplary means for changing the tab 38 from an upward position to a downward position is illustrated in FIG. 7. The tab 38 may be pivotally mounted to the fin 34 by any suitable means such as pivot shafts (not shown). A shaft 42 of a motor 44 may be connected to one of these pivot shafts for rotating the tab 38 about the pivot. The motor 44 is, in turn, powered by a power source 46 through a timer 48 so that at the pre-selected time, namely point 25 (FIG. 1), the tab 38 is changed from the upward position, as shown in FIGS. 3 and 4 to the downward position as illustrated in FIGS. 5 and 6. The power source 46 and timer 48 may be utilized for a motor similar to the motor 44 for simultaneous operation of the tab 40 on the fin 36.

The fins 34 and 36 extend beyond the cylindrical envelope of the capsule 23 and are preferably spaced approximately 90° from one another, the 90° angle defining the underside of the fins. This configuration causes a very desirable dihedral effect to stabilized the weapon system in roll and yaw, which will be explained in more detail hereinafter. Since the fins extend beyond the capsule 23 it is necessary to alter them in some fashion so that the weapon system is compatible for insertion in a torpedo tube. This has been accomplished by folding the fins along a plane 50 which is substantially coextensive with the inward edge 52 of the respective tab 38 when the tab is in a neutral position. This same arrangement also applies for the folidng of the fin 36 so that when both fins are folded the capsule 23 will smoothly fit within the torepdo tube. The outer portion of fin 34 may be foldable along the line 50 by means of hinges 54 and 56. In order to unfold the fin after launch from the torpedo tube a leaf-type spring 58 may be employed between the two portions. This same arrangement can also be utilized for the other fin 36.

Figure 8:
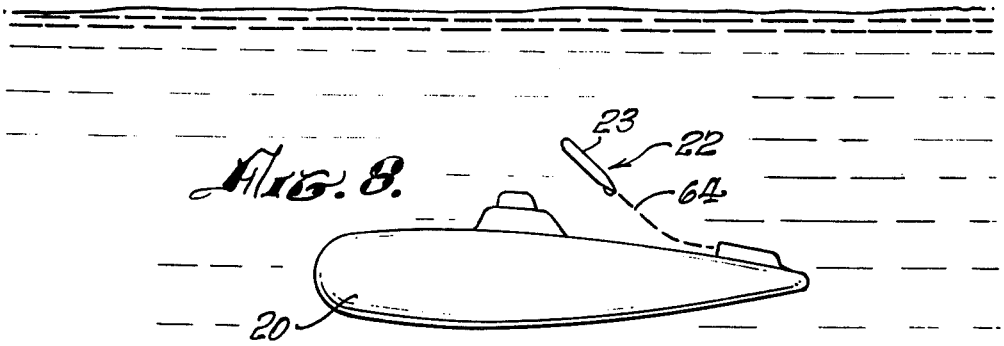
FIG. 8 is an ocean elevation view illustrating a deck launch of another embodiment of the weapon system from a submarine.
Figure 9:
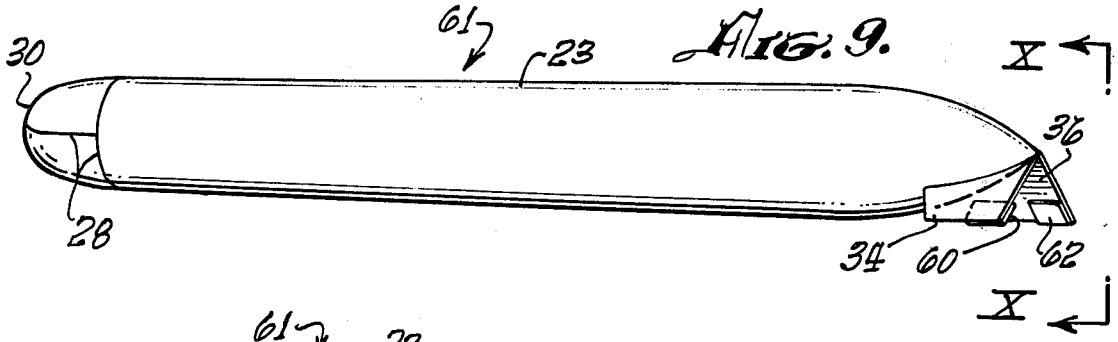
FIG. 9 illustrates an enlarged side view of the weapon system embodiment of FIG. 8.
Figure 10:
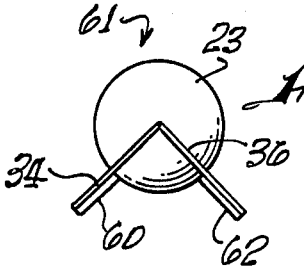
FIG. 10 is a view taken along plane X—X of FIG. 9.

FIGS. 8, 9, and 10 illustrate another embodiment 61 of the present invention. This embodiment is essentially the same weapon system as weapon system 22 with the capsule 23 and fins 34 and 36. The difference is that this weapon system 61 is launched from the deck of a submarine as illustrated in FIG. 8, and there is no requirement for pivotable tabs to change the path of the weapon system after launch. Each fin 34 and 36 of the weapon system 61 has a projection, such as the wedges 60 and 62 respectively, which act in combination to establish the capsule 23 in a stabilized straight line upward glide path 64 as illustrated in FIG. 8. This is the same type of glide path as the glide path 26 of the embodiment in FIGS. 1 and 2. The wedges 60 and 62 are located on the underneath side of the fins 34 and 36. It is not necessary that the weapon system 61 be provided with a means for quickly pitching the capsule 22 upwardly, since the deck launch does not impose the capsule within the forward path of the submarine. The wedges 60 and 62 provide a downward moment on the capsule 23 which counterbalances the moments due to weight, buoyancy, and angle of attack so as to establish the desired upward glide path 64 as illustrated in FIG. 8. The firing of the missile within the capsule 23 at the air sea interface is essentially the same as that illustrated for the other embodiment 22, as shown in FIG. 2.

OPERATION OF THE INVENTION

The operation of the weapon system 22, which is fired from a torpedo tube, is illustrated in FIGS. 1 and 2 of the drawings. The submarine 20 fires the weapon system 22 from a forward torpedo tube, and as soon as the capsule leaves the tube the fins fold to an outwardly fully extended position. As the weapon system 22 leaves the torpedo tube the tabs 38 and 40 are in an upward position, (see FIGS. 3 and 4), which is the quick upward turn position which causes the weapon system to rapidly change its direction upwardly towards a vertical until it reaches point 25 which is the desired attitude for a glide path of the weapon system towards the air-sea interface. At point 25 the tabs 38 and 40 change their positions from the upward positions, illustrated in FIGS. 3 and 4, to the downward positions as illustrated in FIGS. 5 and 6. The means illustrated in FIG. 7 may be utilized for implementing this position change of the tabs. In the positions of the tabs illustrated in FIGS. 5 and 6 a nose-down moment is effected which will counteract the nose-up moments due to weight, buoyancy, and angle of attack of the capsule so as to establish the desired glide path 26. The angle of the glide path is such that it orientates the missile 24 at a desired angle for firing when the capsule breaks the air-sea interface. Further, the buoyancy of the weapon system 22 is such that the capsule is forced out of the water (12 to 15 feet) sufficient for satisfactory firing or the missile.

FIG. 2 illustrates the firing of the missile 24 at which time the separable nose portion of the capsule 23 is broken away and the lower body portion 23 falls back into the ocean. The missile 24 then continues its trajectory towards a target.

The launch of the weapon system 61 from the deck of the submarine is illustrated in FIG. 8. In this embodiment the weapon system is released from the deck of a submarine, and due to wedges 60 and 62 which project downwardly from the fins 34 and 36, the weapon system 61 progresses towards and assumes a glide path 64 which takes the weapon system 61 to the air-sea interface. There is no change of control surfaces on the fins 34 and 36 as described for the first embodiment 22 since the weapon system 61 is not in the path of the submarine after launch.

THEORY OF OPERATION

In setting forth the theory of operation of fins 34 and 36 and the corresponding tabs 38 and 40 of the embodiment 22 or the wedges 60 and 62 of the embodiment 61 the following table illustrates the meanings of the symbols found in the formulas hereinafter:

NOMENCLATURE $A$ — Reference area for hydrodynamic coefficients
$B$ — Static force on body due to displacement
$C_N$ — Normal force coefficient $= N/(\frac{1}{2}\rho V^2 A)$
$C_{N\alpha}$ — $\partial(C_N)/\partial\alpha$
$C_N(\delta)$ — Normal force coefficent due to controls $= n/(\frac{1}{2}\rho V^2 A)$
$C_{M_{C\cdot B}}$ — Moment coefficient relative to body center of buoyancy $= M_{C\cdot B}/(\frac{1}{2}\rho V^2 A l_{ref})$
$C_X$ — Axial force coefficient $= X/(\frac{1}{2}\rho V_2 A)$
$F_X$ — A force along body centerline
$F_Y$ — A force perpendicular to body centerline in vertical plane
$k_2$ — Body's lateral virtual mass divided by its displacement
$l_2$ — Distance center of buoyancy is ahead of center of gravity
$l_n$ — Distance control surface is behind the center of gravity
$l_p$ — Distance center of pressure is behind center of gravity
$l_r$ — Distance center of rotation is ahead of center of gravity
$l_{ref}$ — Reference length for hydrodynamic coefficients
$M_{CB}$ — Hydrodynamic moment about the center of buoyancy
$M_{CG}$ — Moment about the center of gravity (+ nose up)
$M_{cr}$ — Moment about the center of rotation (+ nose up)

Figure 11:
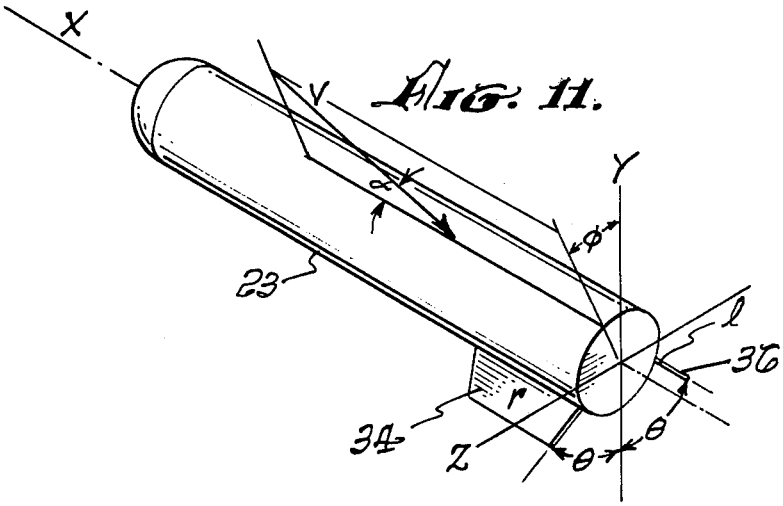
FIGS. 11 and 12 are schematic illustrations of a buoyant body with fins representative of the capsule for explanation of formulas within the description.
Figure 12:
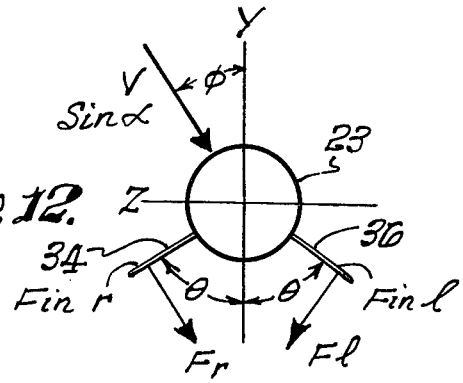

$N$ — Hydrodynamic force perpendicular to body centerline and due to angle of attack
$n$ — Hydrodynamic force perpendicular to body centerline and due to control deflection
$V$ — Speed of body relative to fluid
$V_e$ — Value of V under equilibrium conditions
$W$ — Weight of body
$X$ — Hydrodynamic force along body centerline (+ rearward)
$\alpha$ — Angle body center line makes with body velocity vector
$\alpha_e$ — Value of $\alpha$ under equilibrium conditions
$\beta$ — $(B - W)/B$
$\theta$ — Angle body centerline makes with the horizontal
$\theta_e$ — Value of $\theta$ under equilibrium conditions
$\rho$ — Fluid density
$\eta$ — Control force gain $= -N/n$ The theory of operation of the dihedral effect of the fins 34 and 36 is illustrated in FIGS. 11 and 12, which are a symbolic illustration of the capsule 23.

Many of the aircraft designs of the past have been roll stabilized by including dihedral in the wing configuration. Basically, dihedral requires that two similar lifting surfaces be oriented in roll such that the roll moment due to lift on one surface offsets the moment due to lift on the other surface only when the total angle of attack of the body is included in the single plane of symmetry. If there are more than two major lifting surfaces, the effect of dihedral is drastically reduced.

In most cases, it is impractical to place major lifting surfaces (large when compared to the required pitch stabilizing tail fins) on submarine-launched bodies. It is desirable then to obtain the roll stabilizing dihedral along with the needed pitch and yaw stability moments from the tail fins 34 and 36 alone. This can be obtained by having a tail similar in configuration to that used on the Beech Bonanza family of light aircraft.

Assuming: (1) a body configured similarly to the one shown in FIGS. 11 and 12; (2) that the additional hydrodynamic forces and moments acting on the configuration due to the presence of each fin can be approximated by a force perpendicular to the fin at a span-wise position (S); and (3) that the force is dependent on the product of the total speed of the configuration and the velocity component perpendicular to the plane of the fin and can be expressed as:

$$F(r) = \tfrac{1}{2}\,\rho\, V^2 C_F A_F \sin\alpha \sin(\theta + \phi)$$
$$F(l) = \tfrac{1}{2}\,\rho\, V^2 C_F A_F \sin\alpha \sin(\theta - \phi)$$

then the lateral forces due to the two fins are:

$$-\Delta F_Y = \tfrac{1}{2}\,\rho\, V^2 C_F A_F \sin\alpha\,(2\sin^2\theta \operatorname{Cos}\phi)$$

$$-\Delta F_Z = \tfrac{1}{2}\,\rho\, V^2 C_F A_F \sin\alpha\,(2\cos^2\theta\,{}^{\sin}\phi)$$

and the roll moment is:

$$M_X = \tfrac{1}{2}\,\rho\, V^2 C_F A_F S \sin\alpha\,(2\cos\theta\sin\phi)$$

It is seen that $|\Delta F_Y/\cos\phi|$ and $|\Delta F_Z/\sin\phi|$ represent pitch and yaw stabilizing moments and an increase in one by a change in $\theta$ causes a decrease in the other. The best choice for $\theta$, then, is that which equates the two moments so that the body will be equally stable in pitch and yaw:

$$\sin^2\theta = \cos^2\theta, \quad \theta = \pm\frac{2n+1}{4}\pi \quad (n = 0, 1, \text{etc.})$$

or the fins are 90° apart. The roll moment and force coefficients are then:

$$\Delta C_{N\alpha} = C_F \frac{A_F}{A}$$

$$C_l = \sqrt{2}\,\frac{S}{l_{ref}}\,\Delta C_{N_\alpha}\,\alpha \sin\phi$$

Note that the roll moment is such that the body rotates to keep the fins away from the velocity vector. Note also that the pitching moment is perpendicular to the velocity vector independent of roll orientation so that the side force and pitching moment act as though there are four cruxiform fins, each having one-half the effectiveness of each of the original two.

Figure 13:
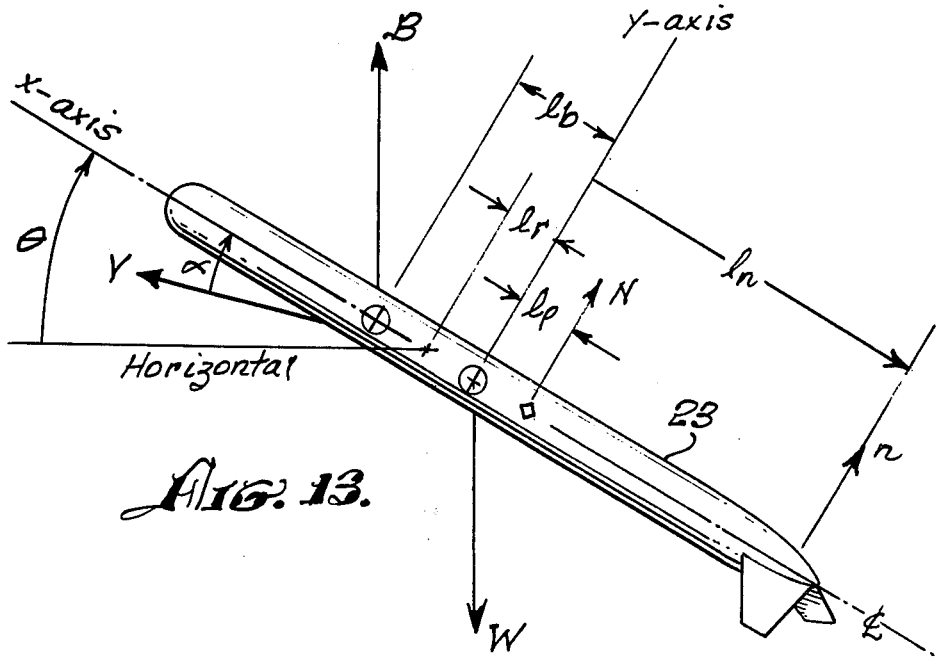
FIG. 13 is a schematic illustration of a buoyant body with fins which have tabs for an explanation of formulas within the description.

The theory of operation of the tabs 38 and 40 or the wedges 60 and 62 during the glide paths 26 or 64 is illustrated in FIG. 13.

In this analysis it is desirable to first determine the values of attitude, velocity, and angle of attack for a body gliding under euqilibrium conditions. For any condition, the forces and moments acting on the body depicted in FIG. 13 is:

$$\Sigma F_X = (B - W)\sin\theta - X$$
$$\Sigma F_Y = (B - W)\cos\theta + (N + n)$$
$$\Sigma M_{CG} = Bl_b\cos\theta - (Nl_p + nl_n)$$

Under equilibrium conditions:
$\theta = \theta_3,\ \alpha = \alpha_e,\ V = V_e$
$\Sigma F_X = 0,\ \Sigma F_Y = 0,\ \Sigma M_{CG} = 0$
From these conditions:

$$\frac{X}{N+n} = -\tan\theta_e\,, \quad B - W = X\sin\theta_e - (N+n)\cos\theta_e$$

$$B = \frac{Nl_p + nl_n}{l_b\cos\theta_e}$$

Now it is desirable to define two parameters:

$$\beta \triangleq \frac{B-W}{B} = -\frac{(N+n)l_b}{Nl_p + nl_n}\,, \quad \eta \triangleq -\frac{N}{n} = -\frac{C_{N\alpha}\alpha_e}{C_N(\delta)}$$

And the control gain is found to be $$\eta = \frac{\beta\dfrac{l_n}{l_b} + 1}{\beta\dfrac{l_p}{l_b} + 1}$$

It should be noted that both $\beta$ and $\eta$ are independent of control coefficient. The equilibrium attitude as a function of control coefficient is found from:

$$\tan\theta_e = \frac{C_x}{C_N(\delta)(\eta - 1)}$$

And equilibrium angle of attack is:

$$\alpha_e = -\eta\,\frac{C_{N(\delta)}}{C_{N_\alpha}}$$

The equilibrium velocity can be obtained from the expression for $(B - W)$:

$$(B - W)\sin\theta_e = \frac{1}{2}\rho V_e^2 A C_X$$

$$V_e^2 = \frac{2(B - W)\sin\theta_e}{\rho A C_X}$$

It is seen then, that $V_e$ is dependent only on weight, shape, and equilibrium attitude. Given weight and shape it is seen from the equation for $\theta_e$ that any attitude from vertical to some minimum value corresponding to the maximum value of $C_N(\delta)$ is available.

In regard to stability during the glide paths 26 or 64 it is assumed that the velocity vector is unchanged and equal to the equilibrium velocity $V_e$. For static stability near equilibrium:

$$\frac{\partial M_{cr}}{\partial\theta} < 0, \quad \frac{\partial\alpha}{\partial\theta} = 1$$

$$\Sigma M_{cr} = [B(l_b - l_r) + Wl_r]\cos\theta - N(l_r + l_p) - n(l_r + l_n)$$

$$\frac{\partial M_{cr}}{\partial\theta} = -[B(l_b - l_r) + Wl_r]\sin\theta_e - \frac{1}{2}\rho V_e^2 A C_{N\alpha}(l_r + l_p)$$

But $$V_e^2 = \frac{2(B - W)\sin\theta_e}{\rho A C_x}, \quad W = B(1 - \beta)$$

From the expression for $\partial M_{cr}/\partial\theta$:

$$l_b - \beta l_r > -\beta\frac{C_{N\alpha}}{C_x}(l_r + l_p)$$

$$l_b > \beta\left[l_r - \frac{C_{N\alpha}}{C_X}(l_r + l_p)\right]$$

From the standpoint of stability, then it appears desirable to have the center of buoyancy as far forward as possible and the center of pressure as far rearward as possible.

Now:

$$C_{M\alpha_{CB}} \quad l_{ref} = -C_{N\alpha}(l_b + l_p)$$

Continuing to develop the above inequality:

$$l_b > \beta\left[l_r - \frac{C_{N\alpha}}{C_x}\left(l_r - l_b - \frac{C_{M\alpha_{CB}}}{C_{N\alpha}}l_{ref}\right)\right]$$

$$\frac{l_b}{l_{ref}}\left[1 - \beta\frac{C_{N\alpha}}{C_x}\right] > \beta\left[\frac{C_{M\alpha_{CB}}}{C_x} + \frac{l_r}{l_{ref}}\left(1 - \frac{C_{N\alpha}}{C_x}\right)\right]$$

Usually $$\beta C_{N\alpha} > C_x$$

$$\frac{l_b}{l_{ref}} < \frac{\left[-C_{M\alpha_{CB}} + \frac{l_r}{l_{ref}}(C_{N\alpha} - C_x)\right]}{C_{N\alpha} - \frac{C_x}{\beta}} \text{ if } \left(C_{N\alpha} > \frac{C_x}{\beta}\right)$$

If the apparent mass of the tail is neglected, an expression for $l_b$ can be obtained independent of $l_r$.

$$l_r W - (l_b - l_r)k_2 B = 0$$

$$l_r = l_b\frac{k_2 B}{k_2 B + W} = \frac{l_b k_2}{k_2 + (1 - \beta)}$$

Then a further development of the inequality is:

$$\frac{l_b}{l_{ref}}(\beta C_{N\alpha} - C_x) < -\beta C_{M\alpha_{CB}} + \frac{C_{N\alpha} - C_x}{l_{ref}}\cdot\frac{\beta l_b k_2}{k_2 + (1 - \beta)}$$

$$\frac{l_b}{l_{ref}}[\beta(1 - \beta)C_{N\alpha} - (k_2(1 - \beta) + (1 - \beta))C_x] < -\beta(k_2 + (1 - \beta))C_{M\alpha_{CB}}$$

$$\frac{l_b}{l_{ref}} < -\frac{(k_2 + (1 - \beta))C_{M\alpha_{CB}}}{(1 - \beta)\left(C_{N\alpha} - (k_2 + 1)\frac{C_x}{\beta}\right)}$$

$$\text{if}\left(C_{N\alpha} > (k_2 + 1)\frac{C_x}{\beta}\right)$$

The last expression should be thought of as a rearward limitation on the position of the center of gravity rather than a forward limitation on the position of the center of buoyancy. If the center of buoyancy is forward of the center of gravity, the above expression demonstrates that the hydrodynamic moment about the center of buoyancy should be negative (stable).

When the center of gravity is significantly forward of the center of buoyancy and the velocity is low compared to $V_e$, the moment due to buoyancy will be overriding and force the nose down. The increased drag and lift will retard the buildup of speed necessary to pull the nose up and a pitch divergence will occur. For this reason, it is preferred that the center of gravity be kept near or behind the center of buoyancy and the hydrodynamic moment about the center of buoyancy be made stable.

It should be noted that the glide paths 26 of FIG. 1 and 64 of FIG. 8 are essentially the reverse of an aircraft glide path. During these upward glide paths, 26 and 64, the weapon system is in a state of equilibrium and will silently ascend in a desired projectory path towards the air-sea interface. This silent operation is extremely important to prevent the enemy from detecting the launch of the weapon system. The depth of firing of the weapon system is not affected by the configuration of the missile contained therein since the capsule can be made to withstand the same kind of pressures the submarine is expected to perform in. In the embodiments of FIGS. 1 and 2 the weapon system can be launched from periscope depth because of the quick turn maneuver to point 25 whereas a deck launch, as illustrated in FIG. 8, should be implemented from some lower depth.

Obviously many modifications and variations of the present invention are possible in the light of the above teachings. It is therefore to be understood that within the scope of the appended claims the invention may be practiced otherwise than as specifically described.

What is claimed is:

1. In a non-propelled submerged launched elongated buoyant body which has fore and aft end and which has a positive metacentric height, the improvement consisting essentially of:

a pair of major fins mounted at the aft end of the body in a spaced apart relationship;

each fin having a tab which is capable of deflecting from an upward position to a downward position with respect to the fin;

the upward position of the tabs acting in combination to implement a pitching movement of the body toward a vertically upward path in the water;

the downward position of the tabs acting in combination to implement a stabilized roll, pitch and yaw movement of the body in substantially a straight line upward non-vertical glide through the water from a position which is established by the pitching movement of the body;

means for simultaneously changing the tabs from the upward positions to the downward positions at a preselected time so that upward positions of the tabs will bring the body to a desired attitude and then a change of the tabs to the downward positions will maintain the body on a constant attitude upward glide path;

said fins extending beyond the body and being spaced approximately 90° from one another;

the body, except for the fins and tabs, having a smooth cylindrical configuration with a rounded nose and a generally ogive tail portion;

each fin being foldable inwardly to clear the cylindrical envelope of the body so that the body can be launched from a torpedo tube; and the fold line of each fin being substantially coextensive with the inward edge of the respective tab.

* * * * *